US007679631B2

(12) United States Patent
Anderson

(10) Patent No.: US 7,679,631 B2
(45) Date of Patent: Mar. 16, 2010

(54) TONER SUPPLY ARRANGEMENT

(75) Inventor: David G. Anderson, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 937 days.

(21) Appl. No.: 11/432,993

(22) Filed: May 12, 2006

(65) Prior Publication Data

US 2007/0263064 A1 Nov. 15, 2007

(51) Int. Cl.
*B41J 2/15* (2006.01)

(52) U.S. Cl. ..... 347/140; 399/258

(58) Field of Classification Search ..... 347/84, 347/85, 140; 399/27, 258, 260, 261, 262
See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,008,713 | A | 4/1991 | Ozawa et al. |
| 5,045,884 | A | 9/1991 | Ohira |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |
| 5,710,968 | A | 1/1998 | Clark et al. |
| 5,778,377 | A | 7/1998 | Marlin et al. |
| 5,826,150 | A | 10/1998 | Folkins |
| 5,884,910 | A | 3/1999 | Mandel |
| 5,995,721 | A | 11/1999 | Rourke et al. |
| 6,059,284 | A | 5/2000 | Wolf et al. |
| 6,125,248 | A | 9/2000 | Moser |
| 6,241,242 | B1 | 6/2001 | Munro |
| 6,297,886 | B1 | 10/2001 | Cornell |
| 6,341,773 | B1 | 1/2002 | Aprato et al. |

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Huan H Tran
(74) *Attorney, Agent, or Firm*—Fay Sharpe LLP

(57) ABSTRACT

A toner supply arrangement for use in an integrated printing system which includes at least one toner container wherein the at least one toner container adapted for supplying toner to at least two image marking engines. The arrangement further includes a distribution mechanism adapted to transport the toner from the at least one toner container to the at least two image marking engines.

23 Claims, 2 Drawing Sheets

U.S. PATENT DOCUMENTS 6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,819,906 B1 11/2004 Herrmann et al.
6,925,283 B1 8/2005 Mandel et al.
6,959,165 B2 10/2005 Mandel et al.
6,973,286 B2 12/2005 Mandel et al.
7,024,152 B2 4/2006 Lofthus et al.
7,136,616 B2 * 11/2006 Mandel et al. ..... 399/388
7,188,929 B2 * 3/2007 Lofthus ..... 347/40
2002/0078012 A1 6/2002 Ryan et al.
2002/0103559 A1 8/2002 Gartstein
2003/0077095 A1 4/2003 Conrow
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2006/0033771 A1 2/2006 Lofthus
2006/0039728 A1 2/2006 deJong et al.
2006/0066885 A1 3/2006 Anderson et al.
2006/0067756 A1 3/2006 Anderson et al.
2006/0067757 A1 3/2006 Anderson et al.

OTHER PUBLICATIONS

Desmond Fretz, "Cluster Printing Solution Announced", Today at Xerox (TAX), No. 1129, Aug. 3, 2001.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalal et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/170,873, filed Jun. 30, 2005, Klassen.
U.S. Appl. No. 11/170,975, filed Jun. 30, 2005, Klassen.
U.S. Appl. No. 11/170,845, filed Jun. 30, 2005, Sampath et al.
U.S. Appl. No. 11/189,371, filed Jul. 26, 2005, Moore et al.
U.S. Appl. No. 11/212,367, filed Aug. 26, 2005, Anderson et al.
U.S. Appl. No. 11/208,871, filed Aug. 22, 2005, Dalal et al.
U.S. Appl. No. 11/215,791, filed Aug. 30, 2005, Hamby et al.
U.S. Appl. No. 11/234,468, filed Sep. 23, 2005, Hamby et al.
U.S. Appl. No. 11/234,553, filed Sep. 23, 2005, Mongeon.
U.S. Appl. No. 11/222,260, filed Sep. 8, 2005, Goodman et al.
U.S. Appl. No. 11/247,778, filed Oct. 11, 2005, Radulski et al.
U.S. Appl. No. 11/248,044, filed Oct. 12, 2005, Spencer et al.
U.S. Appl. No. 11/287,177, filed Nov. 23, 2005, Mandel et al.
U.S. Appl. No. 11/291,583, filed Nov. 30, 2005, Lang.
U.S. Appl. No. 11/291,860, filed Nov. 30, 2005, Willis.
U.S. Appl. No. 11/274,638, filed Nov. 15, 2005, Wu et al.
U.S. Appl. No. 11/287,685, filed Nov. 28, 2005, Carolan.
U.S. Appl. No. 11/317,589, filed Dec. 23, 2005, Biegelsen et al.
U.S. Appl. No. 11/314,774, filed Sep. 21, 2005, Klassen.
U.S. Appl. No. 11/317,167, filed Dec. 23, 2005, Lofthus et al.
U.S. Appl. No. 11/314,828, filed Dec. 21, 2005, Anderson et al.
U.S. Appl. No. 11/292,388, filed Nov. 30, 2005, Mueller.
U.S. Appl. No. 11/292,163, filed Nov. 30, 2005, Mandel et al.
U.S. Appl. No. 11/312,081, filed Dec. 20, 2005, Mandel et al.
U.S. Appl. No. 11/331,627, filed Jan. 13, 2006, Moore.
U.S. Appl. No. 11/341,733, filed Jan. 27, 2006, German.
U.S. Appl. No. 11/359,065, filed Feb. 22, 2005, Banton.
U.S. Appl. No. 11/359,828, filed Feb. 8, 2006, Banton.
U.S. Appl. No. 11/364,685, filed Feb. 28, 2006, Hindi et al.
U.S. Appl. No. 11/363,378, filed Feb. 27, 2006, Anderson et al.
U.S. Appl. No. 11/378,046, filed Mar. 17, 2006, Rizzolo et al.
U.S. Appl. No. 11/378,040, filed Mar. 17, 2006, German.
U.S. Appl. No. 11/403,785, filed Apr. 13, 2006, Banton et al.
U.S. Appl. No. 11/399,100, filed Apr. 6, 2006, Paul.

* cited by examiner

TONER SUPPLY ARRANGEMENT

BACKGROUND

The present disclosure generally relates to electrophotography, and more particularly, to a toner supply arrangement for supplying toner to a plurality of toner replenishing sections or dispensers from a plurality of toner containers installed in association with a plurality of image marking engines or integrated printing system, and the like, based on an electrophotographic process.

Integrated or rack mounted printing systems allow usage of multiple marking engines to move up market (i.e. from office setting to entry print shop production) and to strategically reuse printing technologies to span particular markets. Demands on integrated systems include increases to the average monthly print volume (AMPV). Often the AMPV increases at a faster rate than does the required productivity or print speed of the system. Demands on integrated systems can change the print volume and associated document run length demographics of the individual image marking engines compared to stand alone image marking engines. For example, print volume and document run length demographics of the marking engines can increase when combined as an integrated printing system. The effects can translate positively on the reliability of the system due to the 'truth curve' effect. However, the resultant increase in volume proportionately increases the required customer interactions or interventions with the individual image marking engines for consumables replacement. This situation can exacerbate the intrinsic problem of increased numbers of consumables in these integrated or rack mounted systems.

Individual image marking engines conventionally provided are generally arranged to accommodate toner in an amount commensurate with stand alone or individual use. In the case where copying is effected in a large quantity as described above, it becomes necessary to replenish the toner in one or more image marking engines frequently.

Accordingly, in an integrated printing system, for example, where copying is to be effected in large volumes and/or increased ink or toner coverage per sheet, it is desirable to arrange that the printing system can accommodate as much toner as possible whereby replenishment can be simplified and the frequency of same reduced.

Additionally, if the apparatus is capable of accommodating and transporting toner to the various image marking engines as needed, the amount of work for replenishing toner in the individual image marking engines can be reduced.

SUMMARY

Accordingly, the present disclosure provides a toner supply arrangement for use in an integrated printing system which includes at least one toner container wherein the at least one toner container is adapted for supplying toner to at least two image marking engines. The arrangement further includes a distribution mechanism adapted to transport the toner from the at least one toner container to the at least two image marking engines.

The present disclosure also provides for a printing system comprising a plurality of integrated image making engines each having at least one toner dispenser. The printing system further includes a toner re-supply module integrated therewith having at least one toner container. The at least one toner container is in fluid communication with an associated at least one toner dispenser wherein the at least one container is adapted to supply the at least one dispenser. The fluid communication includes a distribution mechanism adapted to transport toner remotely from the at least one toner container to the associated at least one toner dispenser thereby maintaining the at least one toner dispenser in a substantially full condition.

Further, the present disclosure provides a method for printing comprising a toner supply module including at least one toner container wherein the at least one toner container is adapted for supplying toner to at least two image marking engines. Each image marking engine can have an associated toner dispenser. The method further provides for transporting toner from the at least one toner container to at least two toner dispensers associated with the at least two image marking engines including a distribution mechanism with a first and a second transport pipe for transporting the toner from the at least one toner container to the at least two image marking engines.

CROSS REFERENCE TO RELATED PATENTS AND APPLICATIONS

The following patents/applications, the disclosures of each being totally incorporated herein by reference are mentioned:

Application Ser. No. 11/212,367, filed Aug. 26, 2005, entitled "PRINTING SYSTEM," by David G. Anderson, et al., and claiming priority to U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES";

U.S. Publication No. US-2006-0067756-A1, filed Sep. 27, 2005, entitled "PRINTING SYSTEM," by David G. Anderson, et al., and claiming priority to U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Publication No. US-2006-0067757-A1, filed Sep. 27, 2005, entitled "PRINTING SYSTEM," by David G. Anderson, et al., and claiming priority to U.S. Provisional Patent Application Ser. No. 60/631,918, Filed Nov. 30, 2004, entitled "PRINTING SYSTEM WITH MULTIPLE OPERATIONS FOR FINAL APPEARANCE AND PERMANENCE," and U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE";

U.S. Pat. No. 6,973,286, issued Dec. 6, 2005, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. Application No. US-2006-0012102-A1, published Jan. 19, 2006, entitled "FLEXIBLE PAPER PATH USING MULTIDIRECTIONAL PATH MODULES," by Daniel G. Bobrow; U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. Publication No. US-2006-0033771-A1, published Feb. 16, 2006, entitled "PARALLEL PRINTING ARCHI- TECTURE CONSISTING OF CONTAINERIZED IMAGE MARKING ENGINES AND MEDIA FEEDER MODULES," by Robert M. Lofthus, et al.;

U.S. Pat. No. 7,924,152, issued Apr. 4, 2006, entitled "PRINTING SYSTEM WITH HORIZONTAL HIGHWAY AND SINGLE PASS DUPLEX," by Robert M. Lofthus, et al.;

U.S. Publication No. US-2006-0039728-A1, published Feb. 23, 2006, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. Publication No. US-2006-0039729-A1, published Feb. 23, 2006, entitled "PARALLEL PRINTING ARCHITECTURE USING IMAGE MARKING ENGINE MODULES (as amended)," by Barry P. Mandel, et al.;

U.S. Pat. No. 6,959,165, issued Oct. 25, 2005, entitled "HIGH RATE PRINT MERGING AND FINISHING SYSTEM FOR PARALLEL PRINTING," by Barry P. Mandel, et al.;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski, et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. Pat. No. 6,925,283, issued Aug. 2, 2005, entitled "HIGH PRINT RATE MERGING AND FINISHING SYSTEM FOR PARALLEL PRINTING," by Barry P. Mandel, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application. Ser. No. 11/089,854, filed Mar. 25, 2005, entitled "SHEET REGISTRATION WITHIN A MEDIA INVERTER," by Robert A. Clark, et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. deJong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst, et al.;

U.S. application Ser. No. 11/109,566, filed Apr. 19, 2005, entitled "MEDIA TRANSPORT SYSTEM," by Barry P. Mandel, et al.;

U.S. application Ser. No. 11/109,996, filed Apr. 20, 2005, entitled "PRINTING SYSTEMS," by Michael C. Mongeon, et al.;

U.S. application Ser. No. 11/115,766, Filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,959, filed May 25, 2005, entitled "PRINTING SYSTEMS," by Kristine A. German, et al.;

U.S. application Ser. No. 11/137,634, filed May 25, 2005, entitled "PRINTING SYSTEM," by Robert M. Lofthus, et al.;

U.S. application Ser. No. 11/137,251, filed May 25, 2005, entitled "SCHEDULING SYSTEM," by Robert M. Lofthus, et al.;

U.S. Publication No. US-2006-0066885-A1, filed May 25, 2005, entitled "PRINTING SYSTEM," by David G. Anderson, et al.;

U.S. application Ser. No. 11/143,818, filed Jun. 2, 2005, entitled "INTER-SEPARATION DECORRELATOR," by Edul N. Dalal, et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof, et al.;

U.S. application Ser. No. 11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof, et al.;

U.S. application Ser. No. 11/166,581, filed Jun. 24, 2005, entitled "MIXED OUTPUT PRINT CONTROL METHOD AND SYSTEM," by Joseph H. Lang, et al.;

U.S. application Ser. No. 11/166,299, filed Jun. 24, 2005, entitled "PRINTING SYSTEM," by Steven R. Moore;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath, et al.;

U.S. application Ser. No. 11/189,371, filed Jul. 26, 2005, entitled "PRINTING SYSTEM," by Steven R. Moore, et al.;

U.S. application Ser. No. 11/208,871, filed Aug. 22, 2005, entitled "MODULAR MARKING ARCHITECTURE FOR WIDE MEDIA PRINTING PLATFORM," by Edul N. Dalal, et al.;

U.S. application Ser. No. 11/215,791, filed Aug. 30, 2005, entitled "CONSUMABLE SELECTION IN A PRINTING SYSTEM," by Eric Hamby, et al.;

U.S. application Ser. No. 11/222,260, filed Sep. 8, 2005, entitled "METHOD AND SYSTEMS FOR DETERMINING BANDING COMPENSATION PARAMETERS IN PRINTING SYSTEMS," by Goodman, et al.;

U.S. application Ser. No. 11/234,553, filed Sep. 23, 2005, entitled "MAXIMUM GAMUT STRATEGY FOR THE PRINTING SYSTEMS," by Michael C. Mongeon;

U.S. application Ser. No. 11/234,468, filed Sep. 23, 2005, entitled "PRINTING SYSTEM," by Eric Hamby, et al.;

U.S. application Ser. No. 11/247,778, filed Oct. 11, 2005, entitled "PRINTING SYSTEM WITH BALANCED CONSUMABLE USAGE," by Charles Radulski, et al.;

U.S. application Ser. No. 11/248,044, filed Oct. 12, 2005, entitled "MEDIA PATH CROSSOVER FOR PRINTING SYSTEM," by Stan A. Spencer, et al.; and U.S. application Ser. No. 11/274,638, filed Nov. 15, 2005, entitled "GAMUT SELECTION IN MULTI-ENGINE SYSTEMS," by Wencheng Wu, et al.;

U.S. application Ser. No. 11/287,177, filed Nov. 23, 2005, entitled "MEDIA PASS THROUGH MODE FOR MULTI-ENGINE SYSTEM," by Barry P. Mandel, et al.;

U.S. application Ser. No. 11/287,685, filed Nov. 28, 2005, entitled "MULTIPLE IOT PPHOTORECEPTOR BELT SEAM SYNCHRONIZATION," by Kevin M. Carolan;

U.S. application Ser. No. 11/291,860, filed Nov. 30, 2005, entitled "MEDIA PATH CROSSOVER CLEARANCE FOR PRINTING SYSTEM," by Keith L. Willis;

U.S. application Ser. No. 11/292,388, filed Nov. 30, 2005, entitled "PRINTING SYSTEM," by David A. Mueller;

U.S. application Ser. No. 11/292,163, filed Nov. 30, 2005, entitled "RADIAL MERGE MODULE FOR PRINTING SYSTEM," by Barry P. Mandel, et al.;

U.S. application Ser. No. 11/291,583, filed Nov. 30, 2005, entitled "MIXED OUTPUT PRINTING SYSTEM," by Joseph H. Lang;

U.S. application Ser. No. 11/312,081, filed Dec. 20, 2005, entitled "PRINTING SYSTEM ARCHITECTURE WITH CENTER CROSS-OVER AND INTERPOSER BY-PASS PATH," by Barry P. Mandel, et al.;

U.S. application Ser. No. 11/314,828, filed Dec. 21, 2005, entitled "MEDIA PATH DIAGNOSTICS WITH HYPER MODULE ELEMENTS," by David G. Anderson, et al;

U.S. application Ser. No. 11/314,774, filed Dec. 21, 2005, entitled "METHOD AND APPARATUS FOR MULTIPLE PRINTER CALIBRATION USING COMPROMISE AIM," by R. Victor Klassen;

U.S. application Ser. No. 11/317,589, filed Dec. 23, 2005, entitled "UNIVERSAL VARIABLE PITCH INTERFACE INTERCONNECTING FIXED PITCH SHEET PROCESSING MACHINES," by David K. Biegelsen, et al.;

U.S. application Ser. No. 11/317,167, filed Dec. 23, 2005, entitled "PRINTING SYSTEM," by Robert M. Lofthus, et al.;

U.S. application Ser. No. 11/331,627, filed Jan. 13, 2006, entitled "PRINTING SYSTEM INVERTER APPARATUS", by Steven R. Moore;

U.S. application Ser. No. 11/341,733, filed Jan. 27, 2006, entitled "PRINTING SYSTEM AND BOTTLENECK OBVIATION", by Kristine A. German;

U.S. application Ser. No. 11/349,828, filed Feb. 8, 2005, entitled "MULTI-DEVELOPMENT SYSTEM PRINT ENGINE", by Martin E. Banton;

U.S. application Ser. No. 11/359,065, filed Feb. 22, 2005, entitled "MULTI-MARKING ENGINE PRINTING PLATFORM", by Martin E. Banton;

U.S. application Ser. No. 11/363,378, filed Feb. 27, 2006, entitled "SYSTEM FOR MASKING PRINT DEFECTS", by Anderson, et al.;

U.S. application Ser. No. 11/364,685, filed Feb. 28, 2006, entitled "SYSTEM AND METHOD FOR MANUFACTURING SYSTEM DESIGN AND SHOP SCHEDULING USING NETWORK FLOW MODELING", by Hindi, et al.;

U.S. application Ser. No. 11/378,046, filed Mar. 17, 2006, entitled "PAGE SCHEDULING FOR PRINTING ARCHITECTURES", by Charles D. Rizzolo, et al.;

U.S. application Ser. No. 11/378,040, filed Mar. 17, 2006, entitled "FAULT ISOLATION OF VISIBLE DEFECTS WITH MANUAL MODULE SHUTDOWN OPTIONS", by Kristine A. German, et al.;

U.S. application Ser. No. 11/399,100, filed Apr. 6, 2006, entitled "SYSTEMS AND METHODS TO MEASURE BANDING PRINT DEFECTS", by Peter Paul;

U.S. application Ser. No. 11/403,785, filed Apr. 13, 2006, entitled "MARKING ENGINE SELECTION", by Martin E. Banton et al.

DETAILED DESCRIPTION

Figure 1:
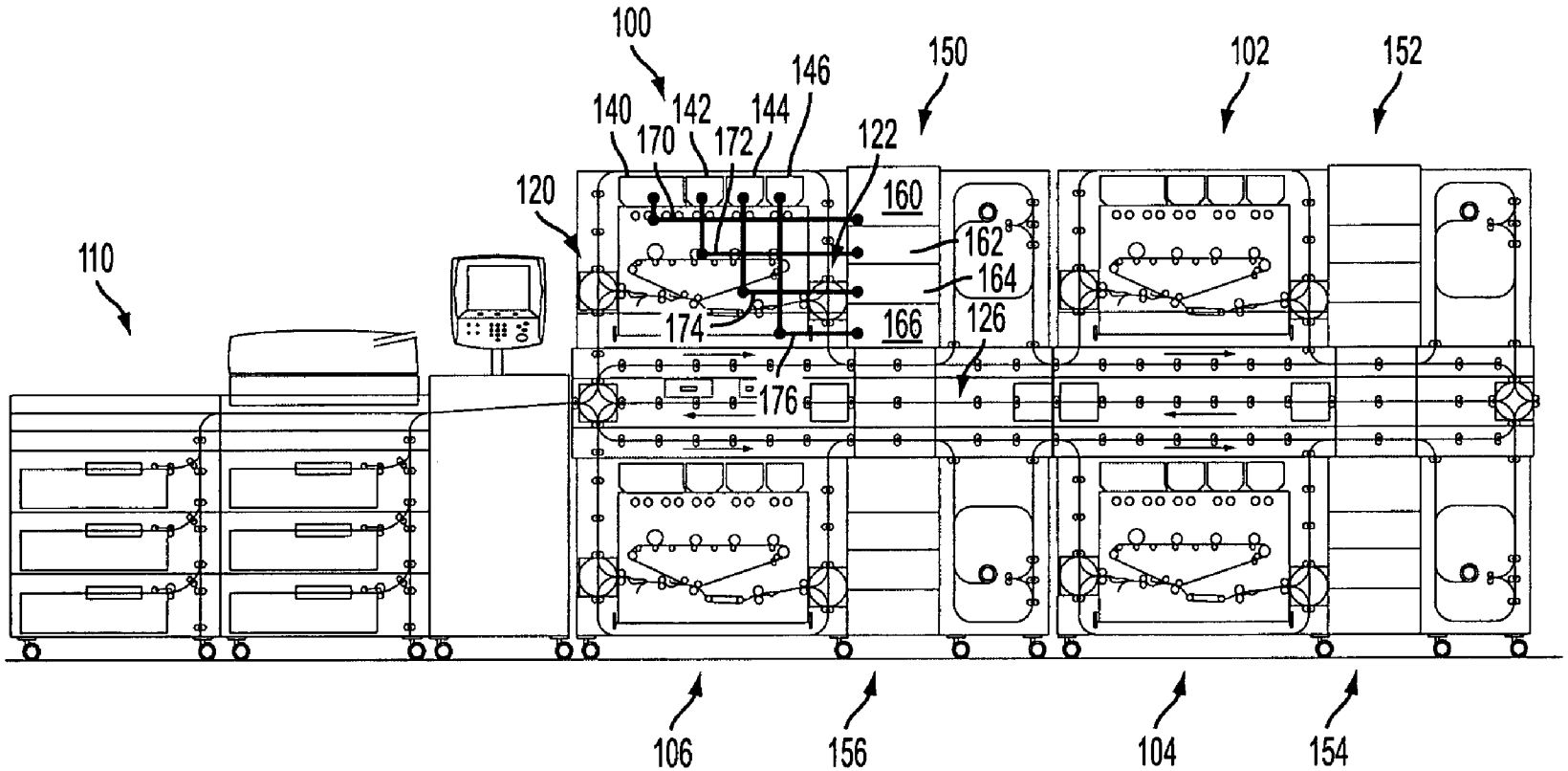
FIG. 1 is a schematic view of an integrated printing system provided with one embodiment of a toner supply arrangement for supplying toner to the integrated printing system; and, FIG. 2 is a schematic view of an integrated printing system provided with another embodiment of a toner supply arrangement for supplying toner to the integrated printing system.

Increased demands on individual image marking engines in an integrated or rack mounted printing system can result from increases in volume demands and increases in color/black toner coverage in response to print requirements or print demographics from an entry level production shop market, for example. The average toner coverage per sheet can increase on a magnitude of from 5% 'black' and 95% 'white' (i.e. office setting) to upwards of 20-30% 'color and black' and 80-70% 'white' (i.e. print shop). The increase to toner coverage per sheet and overall volume demands, coupled with increase to run length demographics (i.e. job size), can result in a 2×, 3×, 4×, or more, order of magnitude increase in toner usage compared with a stand alone image marking engine in an office type environment. This increase to toner demands requires an increase to the frequency of toner replenishments or 'machine interventions'. Existing toner bottles or dispensers are typically made to be as small as possible while conforming to target machine intervention intervals which may correspond to an 'acceptability curve' representing the frequency for which a user finds replenishing the toner bottle acceptable. Toner bottles associated with stand alone image marking engines may have, for example, enough capacity, based on typical usage rates, to last in the range of one month before requiring replacement, replenishment, or other user intervention. A one month replenishment frequency is one example of a target for toner replenishment intervals.

Before the description of the present disclosure proceeds, it is to be noted that like parts are designated by like reference numerals throughout the accompanying drawings. Referring now to the drawings, there is shown in FIG. 1, an integrated printing system including four (4) color image marking engines.

In the architecture of FIG. 1, four marking engines 100, 102, 104, and 106 are shown interposed between a feeder or input module 110 and a finishing or output module (not illustrated). The marking engines can be different types of marking engines, i.e., black only, custom color or color, for high speed integrated printing of documents being transported through the system. The marking engines shown in FIG. 1 are color. Each marking engine can have a first inverter assembly 120 adjacent an entrance to the marking engine 100 and an exit inverter assembly 122 adjacent an exit of the marking engine. As the document is being processed for image transfer through the marking engine 100, the document is transported at a relatively slower speed, herein referred to as engine marking speed. However, when outside of the marking engine 100, the document can be transported through the interconnecting paper transports or high speed highways at a relatively higher speed. In inverter assembly 120 a document exiting the highways 126 at a highway speed can be slowed down before entering marking engine 100 by decoupling the document at the inverter from the highways 126 and by receiving the document at one speed into the inverter assembly, adjusting the reversing process direction motor speed to the slower marking engine speed and then transporting the document at slower speed to the marking engine 100. Additionally, if a document has been printed in marking engine 100, it exits the marking engine at the marking engine speed and can be received in the exit inverter assembly 122 at the marking engine speed, decoupled from the marking engine and transported for re-entering the high speed highway at the highway speed. Alternatively, it is within the scope of the subject embodiments to provide additional paper paths 130 to bypass the input or exit inverter assemblies. It is to be appreciated that an integrated printing system can include a plurality of image marking engines that share common input modules, paper handling transports, and output modules, for example.

Each image marking engine can include a developing apparatus generally having a developing section for feeding toner onto an electrostatic latent image to be formed on an outer peripheral photosensitive surface of a photosensitive or photoreceptor drum, and a dispenser, sub-hopper, or replenishing section for replenishing the toner to the developing section.

Although not illustrated, it is to be appreciated that the dispenser section can include a rotatable stirring vane for mixing and stirring toner and a detecting plate movably disposed therein to follow the surface level of toner, a sensor disposed at a predetermined level on a wall of the dispenser section for detecting the position of said detecting plate, a replenishing mechanism for replenishing the toner into the developing section, and a toner replenishing motor for respectively driving said stirring vane and the replenishing mechanism referred to above.

The toner supply arrangement related to the present disclosure and disposed within the developing apparatus can include four dispensers 140, 142, 144, 146 having similar shape and construction.

As shown in FIG. 1, each image marking engine can include a toner re-supply module or arrangement 150, 152, 154, 156 associated therewith, including large capacity toner containers or reservoirs, wherein each toner dispenser corresponding to each individual color has an associated re-supply container. For example, containers 160, 162, 164, 166 correspond to dispensers 140, 142, 144, 146, respectively. It is to be appreciated that each of the re-supply containers 160, 162, 164, 166 can include a capacity greater than the associated dispenser integral with each image marking engine. Each of the re-supply containers are separate from the associated dispensers and are adapted to be refilled while the image marking engines are marking sheets or otherwise in operation. Thus, refilling the containers does not interrupt operations of any of the image marking engines. Each dispenser can include a sensor for detecting toner levels and initiating refill, whereby the corresponding re-supply container can refill the desired dispenser as needed. Refilling each dispenser 140, 142, 144, 146 from the associated container 160, 162, 164, 166 can include a distribution mechanism, flexible tube, or toner transport pipe 170, 172, 174, 176 therebetween having, for example, an auger or spiral member including a spring rotatable within the tube for transporting the toner from each supply container 160, 162, 164, 166 to the respective dispenser 140, 142, 144, 146. The supply containers are thus in fluid communication with the respective dispensers.

Each of the re-supply containers can include a hopper portion having an opening at its upper portion and a toner transport pipe provided at the bottom portion of the hopper portion for communication therewith, and a lid or door member pivotally provided on the hopper portion so as to selectively open or close the upper opening of the hopper portion (not illustrated). The toner transport pipe can be extended into an upper portion of the respective dispenser for the developing apparatus, with a toner supply port formed at the forward end of said toner transport pipe being arranged to confront a toner receiving port of the dispenser. The auger or spiral member can be rotatably disposed to extend from the bottom portion of the hopper portion through the flexible toner transport pipe so as to be driven for rotation by a toner transport motor. At the bottom portion of the hopper member, a detecting plate for detecting presence or absence of toner can be provided, together with a sensor disposed at a predetermined level on a wall of the hopper portion for detecting the position of the detecting plate.

In the integrated printing system and the toner supply arrangement having constructions as described so far, when the toner is supplied to the photoreceptor drum from the developing apparatus, and the amount of the toner in the dispenser reduced, the toner corresponding in amount to the amount of reduction is replenished from the associated container.

In the container, upon energization of a motor, the spiral member starts rotation, and the toner within the hopper portion is transported towards the forward end of the toner transport pipe so as to be supplied by moving into the dispenser through the toner supply port, and thus, the toner level within the dispenser is restored to the predetermined value. Meanwhile, in a similar manner as in the dispenser, the detecting plate in the container is lowered as the toner is consumed, and upon arrival of the detecting plate at the predetermined level, the sensor is actuated, with a toner replenishing signal indicating such state.

When the toner in the container is consumed to be the empty state, the CPU detects the state based on the signal from the sensor and illuminates the lamp on the GUI. A control panel on the GUI of the integrated printing system can provide an empty state indicating lamp for indicating when any one of the containers is in the state of "toner empty".

It is to be appreciated that the interventions for toner replenishment occurs when one or more of the toner containers require refill and can be initiated when the containers are at or near empty. At this point, when a toner container requires refill, it is to be appreciated that the associated dispenser is still full, or substantially full, and can act as a reserve toner supply. The resultant reserve toner supply can thus be of the magnitude of 6,000 to 10,000 prints, for example. It is to be appreciated that existing systems heretofore available, have only an associated toner dispenser including a sensor for detecting the volume of toner contained therein. The sensor detects when the toner in the toner dispenser reaches a certain level and alerts the operator via the GUI. The amount of toner remaining in the dispenser in this arrangement is of the magnitude of 100s of sheets. This toner amount is adequate when the job runs are in the 10s of sheets as is typical in office settings. But where the print jobs approach several hundred sheets (i.e. high volume production), this amount of forewarning proves inadequate because the job run length and resultant toner demands may exceed the remaining toner (reserve) supply. Thus, in the presently disclosed arrangement, not only are the number of machine interventions reduced, but large print jobs will not deplete the reserve amount of toner now existing in each of the toner dispensers when the replenishment sensor notifies the user that one or more containers require refill.

Figure 2:
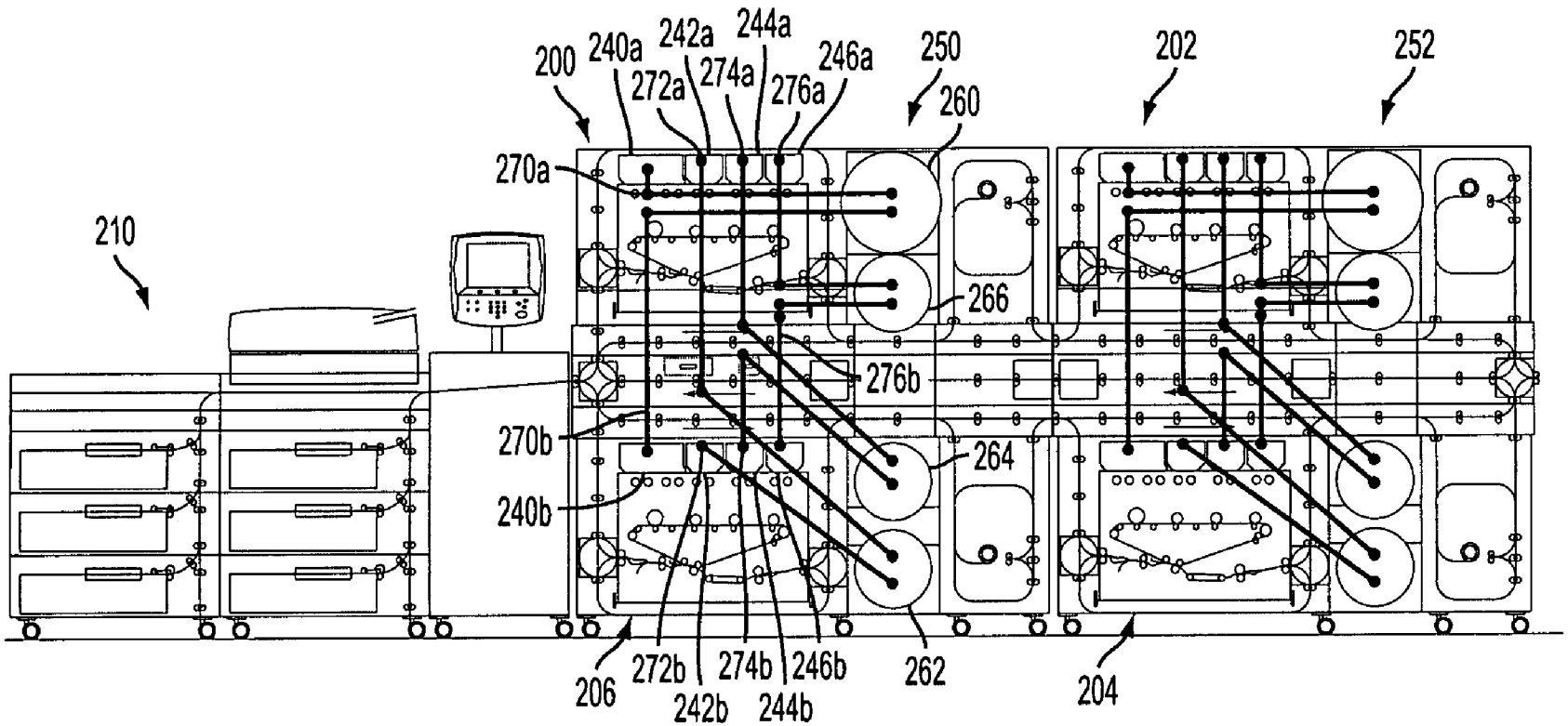

Referring now to FIG. 2, there is shown another embodiment of an integrated printing system including four (4) color image marking engines.

In the architecture of FIG. 2, four marking engines 200, 202, 204, and 206 are shown interposed between a feeder module 210 and a finishing module (not illustrated). The marking engines can be different types of marking engines, i.e., black only, custom color or color, for high speed integrated printing of documents being transported through the system. The marking engines shown in FIG. 2 are color.

Each image marking engine can include a developing apparatus generally having a developing section for feeding toner onto an electrostatic latent image to be formed on an outer peripheral photosensitive surface of a photosensitive or photoreceptor drum, and a dispenser replenishing the toner to the developing section.

The toner supply arrangement related to the present disclosure in accordance with FIG. 2, can include at least two dispensers having similar shape, construction, and toner requirements. The at least two dispensers can be associated with one re-supply container to be described in more detail hereinafter. As shown in FIG. 2, each pair of image marking engines 200, 206, and 202, 204 can include a toner re-supply module 250 and 252, respectively. Each toner re-supply module can include large capacity toner containers wherein 'like' toner dispensers associated with a respective pair of image marking engines can be supplied by a common re-supply container. For example, re-supply module 250 includes containers 260, 262, 264, 266. Each pair of toner dispensers 240*a*/240*b*, 242*a*/242*b*, 244*a*/244*b*, 246*a*/246*b* of engines 200 and 206, corresponding to similar toner, have an associated re-supply container 260, 262, 264, 266. It is to be appreciated that each of the re-supply containers can include a capacity substantially greater than the associated dispensers integral with each image marking engine. Each dispenser can include a sensor for detecting toner levels and initiating refill, whereby the corresponding re-supply container can refill the desired dispensers as needed. Refilling dispensers 240*a*, 240*b*, 242*a*, 242*b*, 244*a*, 244*b*, 246*a*, 246*b* from the associated containers 260, 262, 264, 266 can include flexible tubes or toner transport pipes 270*a*, 270*b*, 272*a*, 272*b*, 274*a*, 274*b*, 276*a*, 276*b* therebetween having, for example, an auger including a spring rotatable within the tube for transporting the toner from each container 260, 262, 264, 266 to the respective dispensers. Although not shown, it is to be appreciated that the containers can be arranged to supply toner to more than two image marking engines.

In the developing apparatus and the toner supply arrangement having constructions as described above, when the toner is supplied to the photoreceptor drum from the developing apparatus, and the amount of the toner in the dispenser reduced, the toner corresponding in amount to the amount of reduction is replenished from the associated container.

When the toner in the container is consumed to be the empty state, the CPU detects the state based on the signal from the sensor and illuminates the lamp on the GUI. A control panel of the integrated printing system can provide an empty state indicating lamp for indicating when any one of the containers is in the state of "toner empty".

It is to be appreciated that each of the re-supply containers can include a capacity substantially greater than the associated dispensers integral with each image marking engine. Each dispenser can include a sensor for detecting toner levels whereby the corresponding re-supply container can refill the desired dispensers as needed. The 'machine interventions' for toner replenishment occurs when one or more of the toner containers require refill and can be initiated when the containers are at or near empty. At this point, it is to be appreciated that the associated dispensers are still full and can act as reserve toner supplies for the respective image marking engine. Refilling the containers can be accomplished while the image marking engines are operating.

In the embodiment shown in FIG. 2, the frequency of machine intervention for toner replenishment is reduced. Further, the number of machine intervention locations, or replenishment stations, is minimized, while at the same time providing for an increased reserve amount of toner.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. In addition, the claims can encompass embodiments in hardware, software, or a combination thereof.

The invention claimed is:

1. A printing system comprising:

a toner supply arrangement including at least one toner container wherein said at least one toner container adapted for supplying toner to at least two integrated image marking engines; and, a distribution mechanism adapted to transport said toner from said at least one toner container to said at least two integrated image marking engines.

2. The printing system of claim 1, wherein said at least two integrated image marking engines are vertically aligned.

3. The printing system of claim 2, wherein said distribution mechanism including a first and a second transport pipe having augers therethrough for transporting said toner from said at least one toner container to said at least two integrated image marking engines.

4. The printing system of claim 1, wherein said at least two integrated image marking engines are horizontally aligned.

5. The printing system of claim 4, wherein said distribution mechanism including a first and a second transport pipe having augers therethrough for transporting said toner from said at least one toner container to said at least two integrated image marking engines.

6. The printing system of claims 5, wherein said distribution mechanism supplying a respective dispenser associated with each of said at least two integrated image marking engines.

7. The printing system of claim 1, further including a first toner detecting mechanism for detecting presence or absence of toner accommodated in said at least one toner container.

8. A printing system comprising:

a plurality of integrated image making engines each having at least one toner dispenser;

said printing system including a toner re-supply module integrated therewith having at least one toner container;

said at least one toner container in fluid communication with an associated said at least one toner dispenser wherein said at least one container adapted to supply said at least one dispenser; and, said fluid communication including a distribution mechanism adapted to transport toner remotely from said at least one toner container to said associated at least one toner dispenser thereby maintaining said at least one toner dispenser in a substantially full condition.

9. The printing system of claim 8, wherein said toner re-supply module including a plurality of toner containers each one of said plurality of toner containers different from each other of said plurality of toner containers.

10. The printing system of claim 8, wherein said distribution mechanism including a transport pipe having an auger therethrough for transporting said toner from said at least one container to said at least one dispenser.

11. The printing system of claim 9, wherein said plurality of toner containers supplying a respective plurality of dispensers associated with said plurality of integrated image marking engines.

12. The printing system of claim 9, further including a first toner detecting mechanism for detecting presence or absence of said toner accommodated in each of said plurality of toner containers.

13. A printing method comprising:

providing a toner supply module including at least one toner container wherein said at least one toner container adapted for supplying toner to at least two integrated image marking engines, each image marking engine having an associated toner dispenser; and, transporting toner from said at least one toner container to at least two toner dispensers associated with said at least two integrated image marking engines including a distribution mechanism with a first and a second transport pipe for transporting said toner from said at least one toner container to said at least two integrated image marking engines.

14. The printing method of claim 13, wherein both said at least two dispensers are remote from said at least one toner container.

15. The printing method of claim 13, wherein said first and second transport pipes each including augers therethrough; and, wherein transporting said toner further including a motor for driving rotation of said augers.

16. The printing method of claim 13, further providing a plurality of toner containers wherein for said at least two integrated image marking engines each one of said plurality of toner containers different from each other of said plurality of toner containers.

17. The printing method of claim 13, further comprising:

maintaining said at least two toner dispensers associated with said at least two integrated image marking engines in a substantially full condition.

18. The printing method of claim 16, further comprising:

detecting presence or absence of toner accommodated in each of said plurality of toner containers.

19. The printing method of claim 18, further comprising:

detecting presence or absence of toner accommodated in each of said at least two toner dispensers.

20. The method of claim 18, further comprising:

displaying the detected result in each of said plurality of toner containers including an indicating lamp on a graphical user interface.

21. The method of claim 13, further comprising:

refilling said at least one container while at least one of said at least two integrated image marking engines are operating.

22. A printing system comprising:

a plurality of integrated image making engines;

at least one toner dispenser for dispensing toner to said plurality of image marking engines;

said printing system including a toner re-supply module integrated therewith having at least one toner container; and, said at least one toner container in fluid communication with said at least one toner dispenser wherein said at least one container adapted to supply said at least one toner dispenser.

23. The printing system of claim 22, said fluid communication including a distribution mechanism adapted to transport toner remotely from said at least one toner container to said at least one toner dispenser thereby maintaining said at least one toner dispenser in a substantially full condition.

* * * * *